US007883246B2

(12) United States Patent
Blincoe et al.

(10) Patent No.: US 7,883,246 B2
(45) Date of Patent: Feb. 8, 2011

(54) LIGHTING FIXTURE AND METHOD

(75) Inventors: Patrick Stephen Blincoe, Kirkville, NY (US); Clifford Randy Helmer, Fulton, NY (US)

(73) Assignee: Cooper Technologies Company, Houston, TX (US)

( * ) Notice: Subject to any disclaimer, the term of this patent is extended or adjusted under 35 U.S.C. 154(b) by 9 days.

(21) Appl. No.: 12/167,475

(22) Filed: Jul. 3, 2008

(65) Prior Publication Data

US 2008/0266868 A1 Oct. 30, 2008

Related U.S. Application Data

(63) Continuation of application No. 11/412,387, filed on Apr. 27, 2006, now abandoned.

(51) Int. Cl.
*F21V 29/00* (2006.01)

(52) U.S. Cl. ..... 362/373; 362/294; 362/547

(58) Field of Classification Search ..... 362/264–265, 362/294, 218, 373, 547; 313/485, 318.04, 313/324, 34, 44, 46
See application file for complete search history.

(56) References Cited

U.S. PATENT DOCUMENTS

| | | | | |
|---|---|---|---|---|
| 5,492,477 | A * | 2/1996 | Moon | 439/57 |
| 6,394,628 | B1 | 5/2002 | Wang | 362/375 |
| 6,517,218 | B2 * | 2/2003 | Hochstein | 362/294 |
| 6,787,999 | B2 * | 9/2004 | Stimac et al. | 315/51 |
| 6,874,914 | B2 | 4/2005 | Desanto et al. | 362/372 |
| 6,974,230 | B1 | 12/2005 | Ruud et al. | 362/265 |
| 7,350,940 | B2 * | 4/2008 | Haugaard et al. | 362/294 |
| 7,524,089 | B2 * | 4/2009 | Park | 362/294 |
| 2003/0165058 | A1 * | 9/2003 | Osborn, Jr. | 362/265 |
| 2007/0070645 | A1 * | 3/2007 | Coushaine et al. | 362/555 |

OTHER PUBLICATIONS

Product Information Bulletin: ICETRON Inductively Coupled Electrodeless Systems, OSRAM Sylvania, May 2002, pp. 1-4.
Philips Lighting B.V., Philips QL Lamp Systems, Information for Original Equipment Manufacturers, Dec. 2004, pp. 1-23.
May, Robert J., Non-Final Office Action mailed Aug. 13, 2007 in U.S. Appl. No. 11/412,387, pp. 1-15.
May, Robert J., Final Office Action mailed Apr. 3, 2008 in U.S. Appl. No. 11/412,387, pp. 1-14.

* cited by examiner

*Primary Examiner*—Robert J May
(74) *Attorney, Agent, or Firm*—King & Spalding LLP

(57) ABSTRACT

Lighting fixtures and associated methods are provided herein. Generally, the lighting fixtures of the present invention include a lamp, a power coupler, a high-frequency generator, a mounting block adapted to receive heat from the high-frequency generator, and a device adapted to receive heat from the power coupler. In some embodiments, methods include consuming at least about 165+/−10% watts of power using a lighting fixture of the present invention, providing at least about 12,000 initial lumens using the lighting fixture, and providing the lamp with an average life of at least about 100,000 hours with a 50% failure rate. In some embodiments, methods include consuming at least about 165+/−10% watts of power using a lighting fixture of the present invention, and maintaining the temperature rise above ambient of at least a portion of the high-frequency generator at less than about 32 degrees C.

18 Claims, 11 Drawing Sheets

| CANDELAS | | ZONAL LUMENS | |
|---|---|---|---|
| VERTICAL ANGLE | CANDELA | WITH ZONE | LUMENS |
| 0 | 857 | 0-10 | 83 |
| 5 | 860 | 10-20 | 263 |
| 15 | 926 | 20-30 | 454 |
| 25 | 982 | 30-40 | 635 |
| 35 | 1012 | 40-50 | 807 |
| 45 | 1041 | 50-60 | 975 |
| 55 | 1086 | 60-70 | 1113 |
| 65 | 1123 | 70-80 | 1198 |
| 75 | 1133 | 80-90 | 1223 |
| 85 | 1122 | 90-100 | 1205 |
| 90 | 1112 | 100-110 | 1111 |
| 95 | 1106 | 110-120 | 930 |
| 105 | 1052 | 120-130 | 676 |
| 115 | 939 | 130-140 | 396 |
| 125 | 754 | 140-150 | 157 |
| 135 | 509 | 150-160 | 22 |
| 145 | 245 | 160-170 | 0 |
| 155 | 36 | 170-180 | 0 |
| 165 | 1 | TOTAL | 11248 |
| 175 | 0 | | |
| 180 | 0 | | |

ROOM CAVITY RATIO

| EFFECTIVE CEILING | WALL | 1 | 2 | 3 | 4 | 5 | 6 | 7 | 8 | 9 | 10 |
|---|---|---|---|---|---|---|---|---|---|---|---|
| 80% | 50% | .834 | .700 | .603 | .525 | .458 | .405 | .361 | .323 | .291 | .264 |
| | 30% | .781 | .623 | .516 | .435 | .367 | .316 | .275 | .241 | .211 | .188 |
| | 10% | .732 | .558 | .447 | .366 | .300 | .253 | .215 | .184 | .158 | .138 |
| 70% | 50% | .776 | .650 | .560 | .487 | .425 | .376 | .336 | .301 | .270 | .246 |
| | 30% | .728 | .581 | .482 | .406 | .343 | .295 | .257 | .225 | .197 | .176 |
| | 10% | .685 | .522 | .419 | .343 | .281 | .237 | .202 | .172 | .148 | .129 |
| 50% | 50% | .666 | .555 | .477 | .416 | .362 | .321 | .287 | .257 | .231 | .211 |
| | 30% | .629 | .500 | .415 | .350 | .295 | .255 | .222 | .194 | .170 | .152 |
| | 10% | .595 | .453 | .364 | .299 | .244 | .205 | .175 | .149 | .127 | .111 |
| 30% | 50% | .566 | .467 | .401 | .350 | .304 | .269 | .241 | .217 | .195 | .178 |
| | 30% | .537 | .425 | .352 | .297 | .250 | .215 | .188 | .164 | .144 | .129 |
| | 10% | .510 | .387 | .311 | .255 | .207 | .174 | .148 | .126 | .107 | .094 |
| 10% | 50% | .473 | .386 | .331 | .288 | .249 | .221 | .198 | .178 | .160 | .147 |
| | 30% | .451 | .354 | .293 | .247 | .206 | .178 | .155 | .135 | .118 | .106 |
| | 10% | .431 | .324 | .260 | .213 | .172 | .144 | .122 | .104 | .088 | .076 |
| 0% | 0% | .384 | .282 | .222 | .178 | .141 | .116 | .097 | .080 | .066 | .057 |

FOOTCANDLE VALUES FOR ISOFOOTCANDLE LINES

| MTG. HEIGHT | A | B | C | D | E |
|---|---|---|---|---|---|
| 10' | 5.00 | 2.00 | 1.00 | .050 | 0.20 |
| 12' | 3.47 | 1.39 | 0.69 | 0.35 | 0.14 |
| 16' | 1.95 | 0.78 | 0.39 | 0.20 | 0.08 |
| 20' | 1.25 | 0.50 | 0.25 | 0.13 | 0.05 |
| 25' | 0.80 | 0.32 | 0.16 | 0.08 | 0.03 |

LIGHTING FIXTURE AND METHOD

CROSS-REFERENCE TO RELATED APPLICATIONS

The present application is a continuation of U.S. patent application Ser. No. 11/412,387, titled "Lighting Fixture and Method" and filed on Apr. 27, 2006, in the name of Patrick Blincoe et al, the entire disclosure of which is hereby fully incorporated herein by reference.

TECHNICAL FIELD

The present disclosure relates to luminaires or lighting fixtures such as, for example, induction luminaires or lighting fixtures.

BACKGROUND OF THE INVENTION

Current hazardous area fixtures available typically utilize high intensity discharge (HID) lamp sources or bulbs because they do not discharge a high amount of heat which could create a safety problem, especially in areas where flammable gases, vapors, or dust may be present. While HID bulbs are satisfactory for use in some hazardous area fixtures, the disadvantage of using HID bulbs is that they only provide an average lamp life of approximately 8,000 hours. Thus, replacing these bulbs relatively frequently is time consuming and expensive.

Accordingly, there exists a need for a hazardous area fixture which uses a lamp source having a life expectancy much greater than a standard HID bulb, while not producing an excessive amount of heat for safety concerns.

BRIEF SUMMARY OF THE INVENTION

The present invention provides an induction luminaire or lighting fixture that can be used in hazardous areas.

In some embodiments, the present invention provides a lighting fixture having a lamp, a power coupler coupled to the lamp, a high-frequency generator electrically coupled to the power coupler, a housing defining a region in which the high-frequency generator is disposed, a mounting block coupled to the housing and the high-frequency generator, the mounting block being adapted to receive heat from the high-frequency generator, and a device coupled to the power coupler and the housing, the device being adapted to receive heat from the power coupler.

In some embodiments, the present invention provides a method comprising consuming at least about 165+/−10% watts of power using a lighting fixture, the lighting fixture having a lamp, providing at least about 12,000 initial lumens using the lighting fixture, and providing the lamp with an average life of at least about 100,000 hours with a 50% failure rate.

In some embodiments, the present invention provides a system having means for consuming at least about 165+/−10% watts of power using a lighting fixture, the lighting fixture having a lamp, means for providing at least about 12,000 initial lumens using the lighting fixture; and means for providing the lamp with an average life of at least about 100,000 hours with a 50% failure rate.

The features and advantages of the present invention will be apparent to those skilled in the art. While numerous changes may be made by those skilled in the art, such changes are within the spirit of the invention.

DETAILED DESCRIPTION

Figure 1:
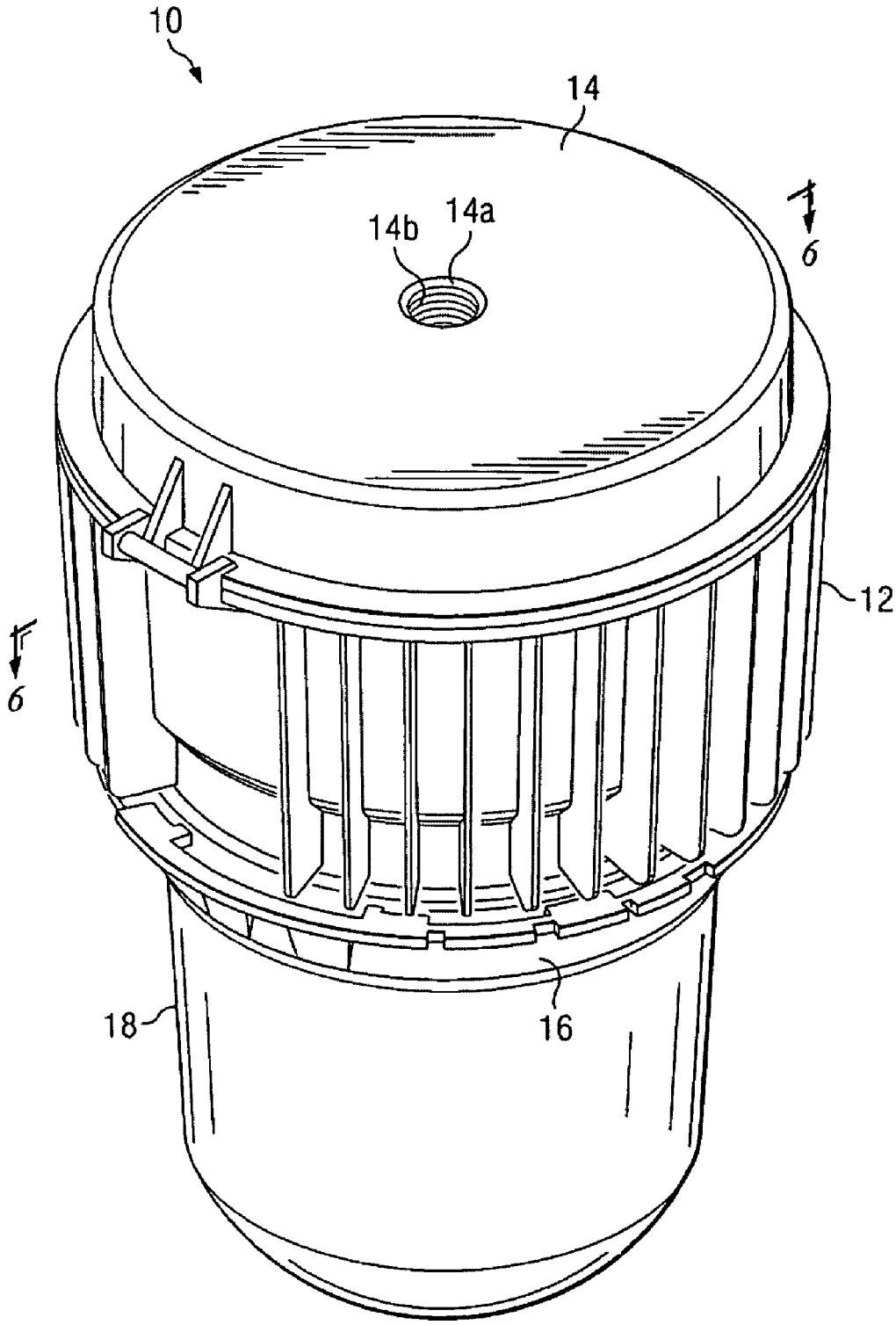
FIG. 1 is a perspective view of a lighting fixture according to an embodiment, the lighting fixture including a housing and a coyer coupled thereto.

In an exemplary embodiment, as illustrated in FIG. 1, a luminaire or lighting fixture is generally referred to by the reference numeral 10 and includes a housing 12 and a cover 14 hingedly coupled thereto, the cover 14 including an opening 14*a* having an internal threaded connection 14*b*. A globe adapter 16 is coupled to the housing 12, and a globe 18 is coupled to the globe adapter 16.

Figure 2:
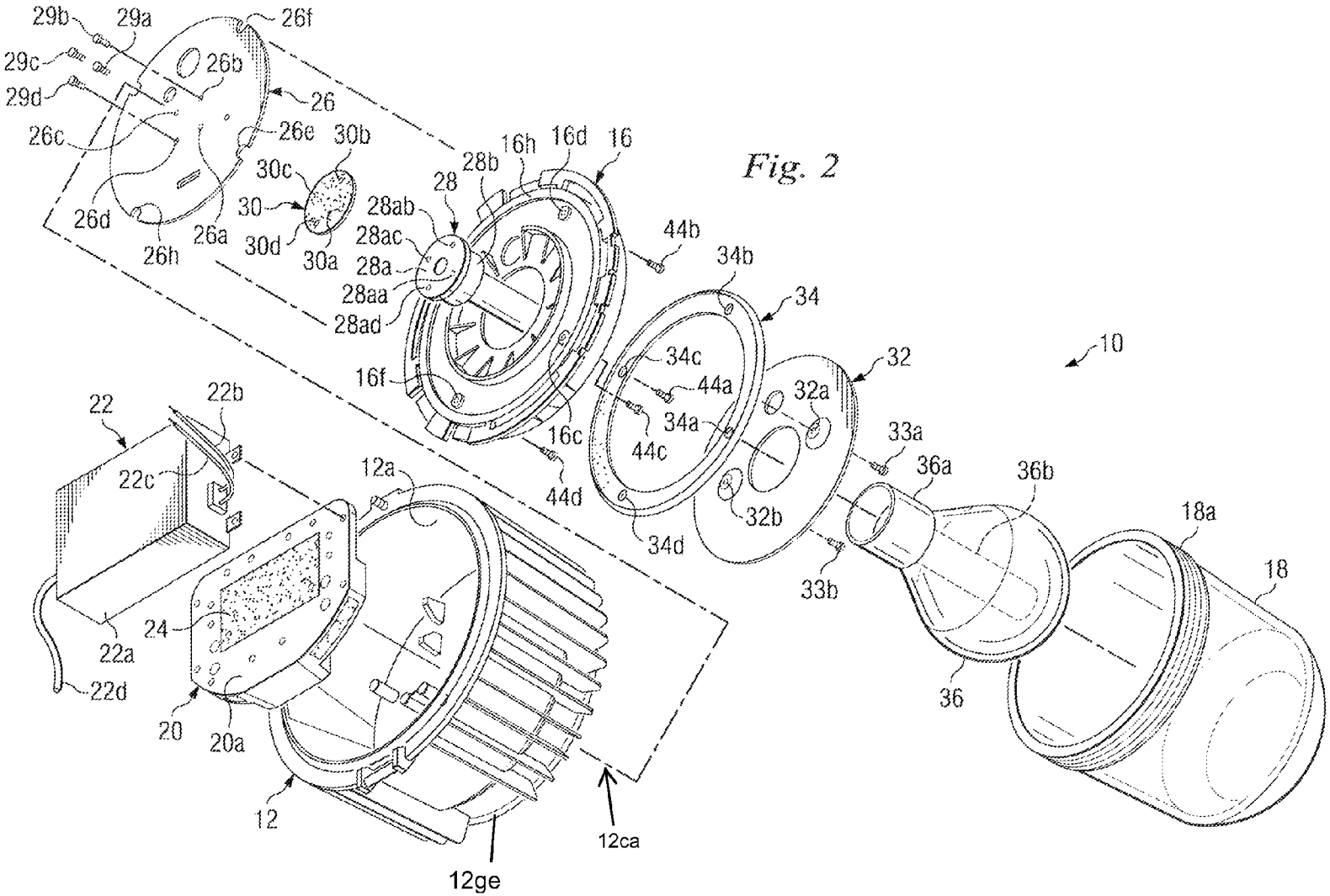
FIG. 2 is an exploded view of the lighting fixture of FIG. 1, with the cover removed from view.
Figure 3:
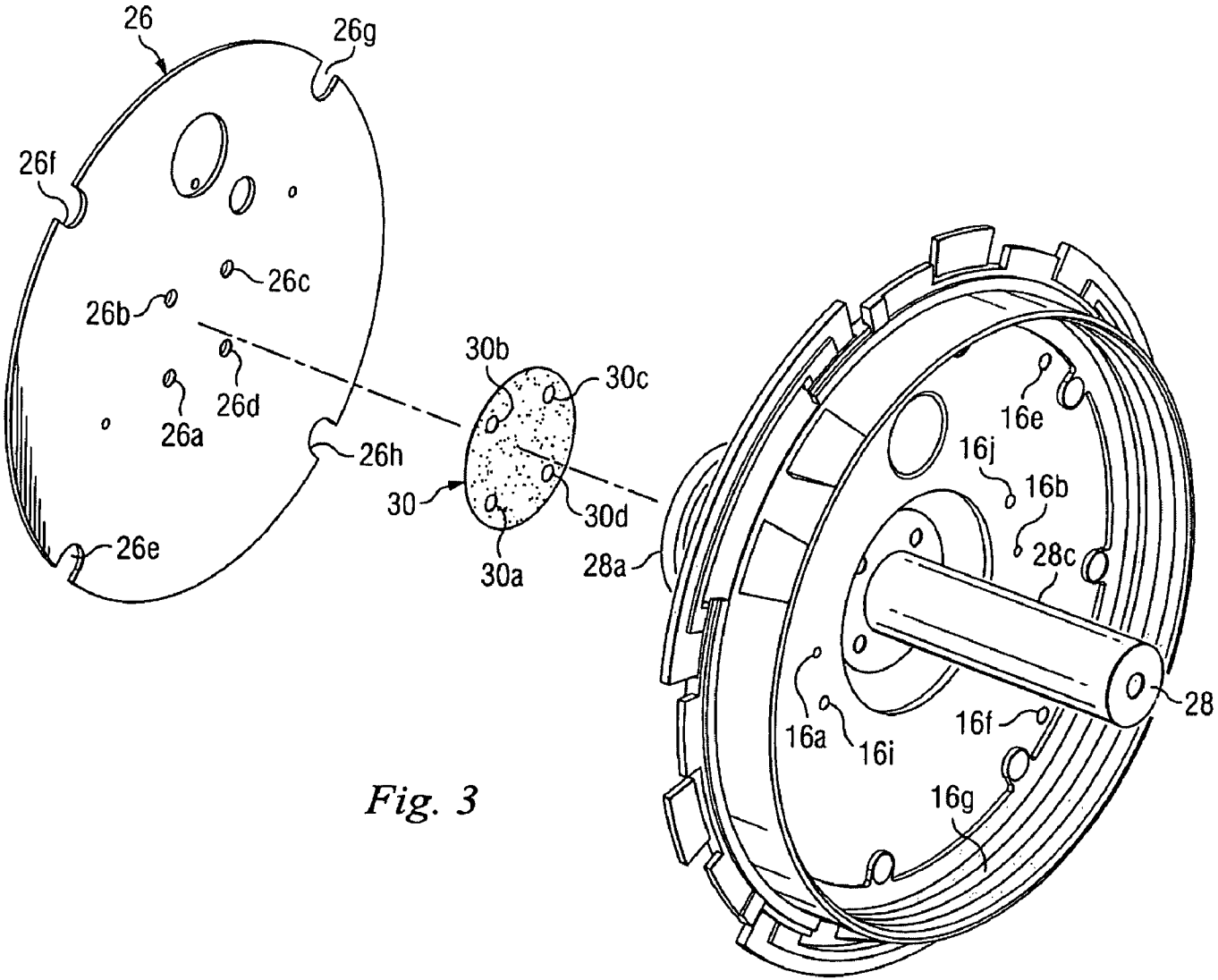
FIG. 3 is an exploded view of selected components of the lighting fixture of FIG. 1, which are depicted in FIG. 2.

In an exemplary embodiment, as illustrated in FIGS. 2 and 3, the housing 12 includes a central axis 12*ca* and defines a first region, or first portion, 12*a* in which a mounting block 20 is disposed. The mounting block 20 is coupled to the housing 12 and defines a surface 20*a*. A high-frequency (HF) generator 22 is coupled to the mounting block 20, engaging the surface 20*a*, and includes a housing 22*a*, and wires 22*b* and 22*c* and a coaxial cable 22*d* extending into and out of the housing 22*a*, respectively. The HF generator 22 is adapted to receive line electrical power and supply output power in the form of a low voltage, high-frequency current signal such as, for example, a 2.65 Mhz current signal, in a manner and under conditions to be described. In several exemplary embodiments, the HF generator 22 comprises an oscillator enclosed within the housing 22*a* and to which the wires 22*b* and 22*c*, and the coaxial cable 22*d*, are electrically coupled.

A thermal pad 24 is disposed between the HF generator 22 and the surface 20*a* of the mounting block 20. The thermal pad 24 is adapted to provide a thermally-conductive interface between the housing 22*a* of the HF generator 22, and the surface 20*a* of the mounting block 20, under conditions to be described. In an exemplary embodiment, the thermal pad 24 is adapted to fill one or more air gaps between the housing 22*a* and the surface 20*a*, and comprises a material having a relatively high thermal conductivity. In an exemplary embodiment, the thermal pad 24 comprises a material having a thermal conductivity of about 6 W/mK. In an exemplary embodiment, the thermal pad 24 comprises a thickness of about 0.020 inches. In an exemplary embodiment, the thermal pad 24 comprises an operational temperature range from about −45 degrees C. to about 200 degrees C. In an exemplary embodiment, the thermal pad 24 comprises T-pli™ 220 gap filler, available from Thermagon, Inc. of Cleveland, Ohio, and/or a material comprising mechanical and physical properties that are substantially similar to the properties of T-pli™ 220 gap filler.

A power-coupler mounting plate 26 is engaged with the housing 12 at a terminus 12*ge*, and includes circumferentially-spaced through-holes 26*a*, 26*b*, 26*c* and 26*d*, and circumferentially-spaced notches 26*e*, 26*f*, 26*g* and 26*h*. In an exemplary embodiment, the power-coupler mounting plate 26 comprises a thermal conductivity of about 167 W/mK. In an exemplary embodiment, the power-coupler mounting plate 26 comprises an aluminum alloy. In an exemplary embodiment, the power-coupler mounting plate 26 comprises 6061 T6 aluminum alloy.

A power coupler 28 is coupled to the mounting plate 26, and includes a mounting flange 28*a*, a base 28*b* and a cylindrical portion 28*c* extending from the base 28*b*. The mounting flange 28*a* includes circumferentially-spaced holes 28*aa*, 28*ab*, 28*ac* and 28*ad*. Fasteners 29*a*, 29*b*, 29*c* and 29*d* extend through the through-holes 26*a*, 26*b*, 26*c* and 26*d*, respectively, and into the holes 28*aa*, 28*ab*, 28*ac* and 28*ad*, respectively, thereby coupling the power coupler 28 to the mounting plate 26. In an exemplary embodiment, each of the fasteners 29*a*, 29*b*, 29*c* and 29*d* comprises a screw adapted to be torqued to 18-22 lb-in.

The power coupler 28 is adapted to transfer energy from the HF generator 22 in a manner and under conditions to be described. In an exemplary embodiment, the cylindrical portion 28*c* comprises an antenna comprising a coil and a ferrite core, which together are adapted to produce a high-frequency magnetic field such as, for example, a 2.65 Mhz magnetic field.

A thermal pad 30 is disposed between the mounting plate 26 and the mounting flange 28*a* of the power coupler 28, and is adapted to provide a thermally-conductive interface between the mounting plate 26 and the mounting flange 28*a*, under conditions to be described. The thermal pad 30 includes circumferentially-spaced through-holes 30*a*, 30*b*, 30*c* and 30*d*, through which the fasteners 29*a*, 29*b*, 29*c* and 29*d* extend, respectively. In an exemplary embodiment, the thermal pad 30 is adapted to fill one or more air gaps between the mounting plate 26 and the mounting flange 28*a*. In several exemplary embodiments, the thermal pad 30 comprises a thickness of about 0.020 inches. In several exemplary embodiments, the thermal pad 30 comprises a material that is substantially similar to the material of which the thermal pad 24 is comprised, as described above.

An inner reflector 32 is coupled to the globe adapter 16 via fasteners 33*a* and 33*b*, which extend through respective through-holes 32*a* and 32*b* of the reflector 32 and respective through-holes 16*a* and 16*b* of the globe adapter 16 axially aligned therewith. A globe gasket 34 is disposed between the globe adapter 16 and the inner reflector 32, and includes through-holes 34*a*, 34*b*, 34*c* and 34*d*. The globe adapter 16 includes through-holes 16*c*, 16*d*, 16*e* and 16*f*, and an internal threaded connection 16*g*, with which an external threaded connection 18*a* of the globe 18 is threadably engaged. The globe adapter 16 further includes a circumferentially-extending channel in which a globe adapter gasket 16*h* is disposed, and through-holes 16*i* and 16*j* through which respective fasteners (not shown) extend to couple the globe adapter 16 to the mounting plate 26.

A lamp cap 36*a* of a lamp 36 is coupled to the base 28*b* of the power coupler 28 so that the cylindrical portion 28*c* extends into a stem 36*b* of the lamp 36. In an exemplary embodiment, the lamp 36 comprises a glass bulb containing an amalgam or mercury metal mixture and an inert buffer gas. In an exemplary embodiment, the inside wall of the lamp 36 is coated with a fluorescent phosphor mixture such as, for example, 3-line Super/80 phosphorous used in TL-D, TL-5 and/or PL type lamps. In an exemplary embodiment, the HF generator 22, the power coupler 28 and the lamp 36 together at least partially define an induction lamp system so that the lighting fixture 10 is considered to be an induction luminaire or an induction lighting fixture. In an exemplary embodiment, the induction lamp system at least partially defined by the HF generator 22, the power coupler 28 and the lamp 36 comprises a 165-watt induction lamp system. In an exemplary embodiment, the induction lamp system at least partially defined by the HF generator 22, the power coupler 28 and the lamp 36 comprises one or more components of a Philips QL Induction Lamp System, available from Philips Lighting, B.V. In several exemplary embodiments, instead of, or in addition to an induction lamp system, the lamp 36 may comprise one or more high-intensity-discharge (HID) lamps such as, for example, a high pressure sodium lamp, a pulse start metal halide lamp, a metal halide lamp, and/or any combination thereof, and/or may comprise one or more incandescent or fluorescent lamps.

Figure 4B:
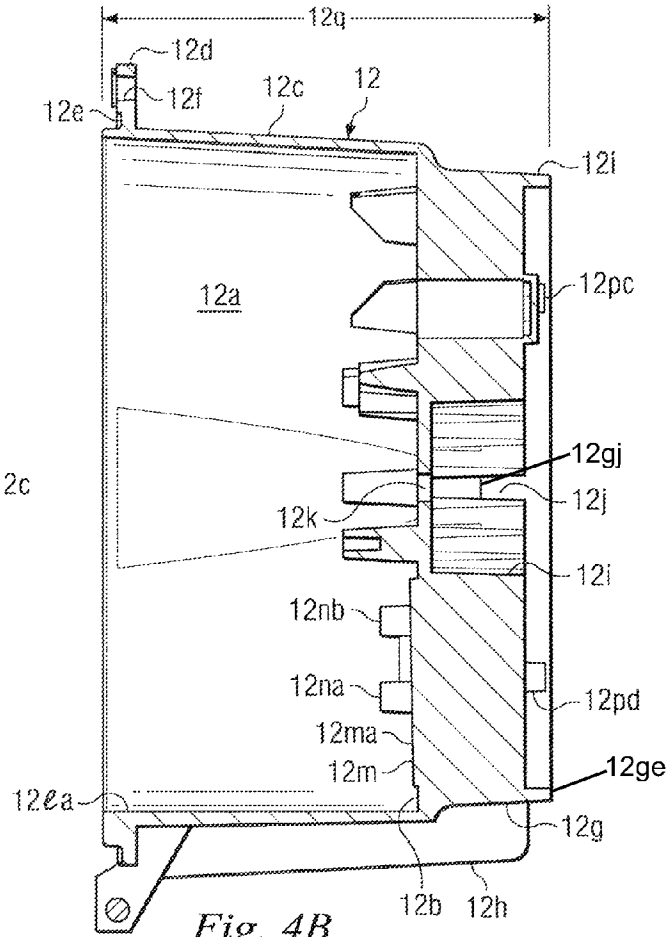
FIG. 4B is a sectional view of the housing of FIG. 4A taken along line 4B-4B.
Figure 4A:
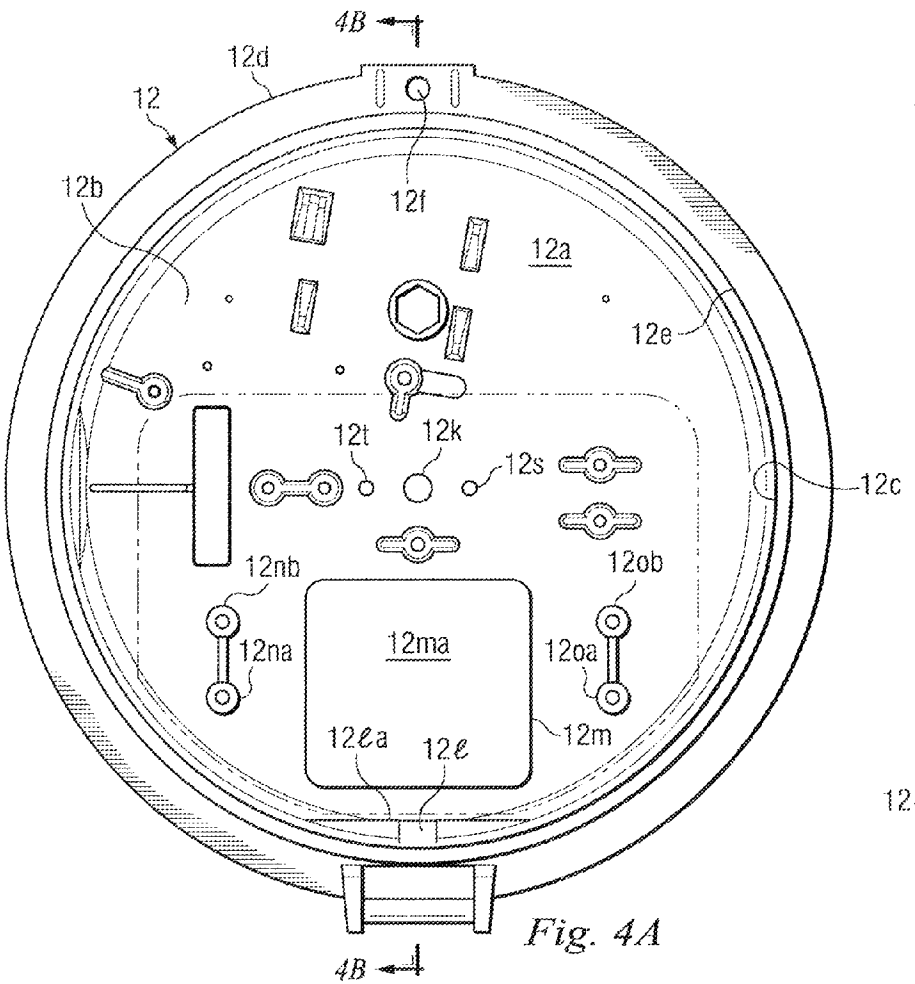
FIG. 4A is a top plan view of the housing of the lighting fixture of FIG. 1.
Figure 4C:
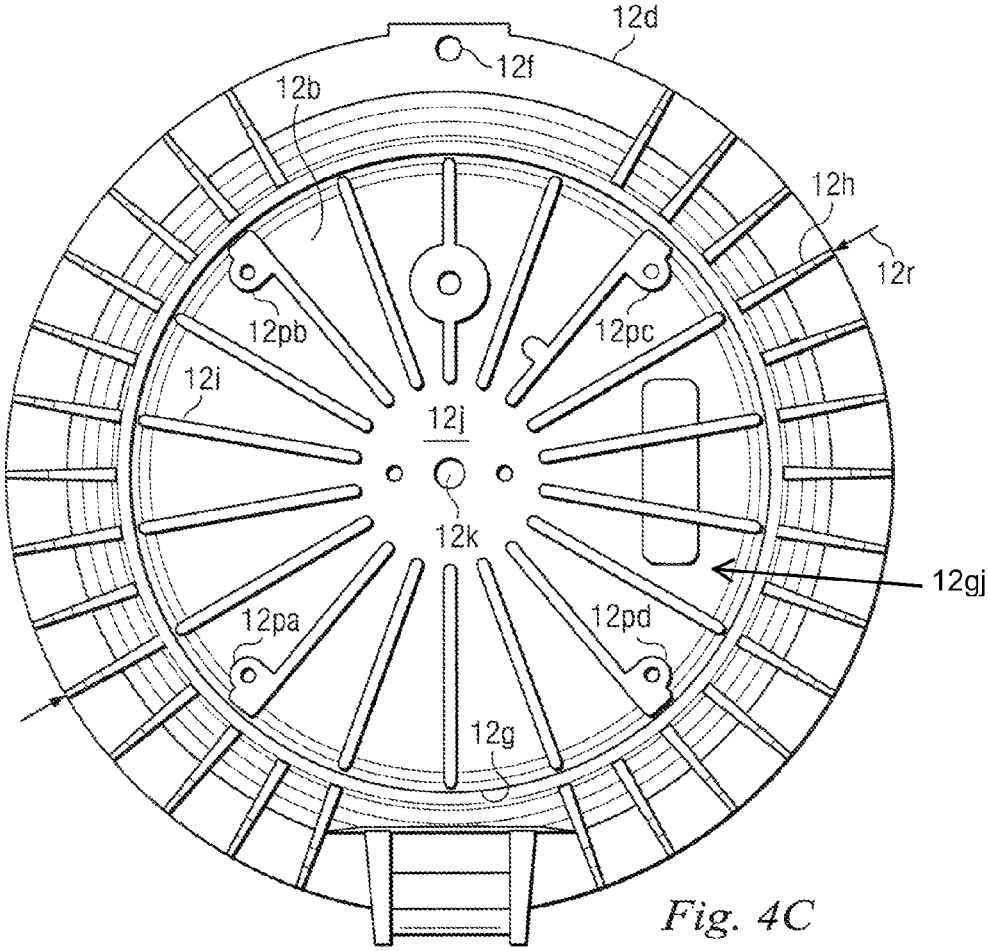
FIG. 4C is a bottom plan view of the housing of FIGS. 4A and 4B.

In an exemplary embodiment, as illustrated in FIGS. 4A, 4B and 4C, the housing 12 further includes a generally disk-shaped base wall 12*b* and a circumferentially-extending wall 12*c* that extends from the base wall 12*b*. As shown in FIG. 4B, the wall 12*c* includes a draft, extending from the base wall 12*b* at a relatively small angle from the horizontal. The first region, or first portion, 12*a* is generally defined by the base wall 12*b* and the wall 12*c*. A lip 12*d* extends radially outward from the wall 12*c* and a circumferentially-extending channel 12*e* is formed in the lip 12*d*. An opening 12*f* extends through the lip 12*d*. A circumferentially-extending wall 12*g* having the terminus 12*ge* extends from the base wall 12*b* in a direction generally opposing the direction of extension of the wall 12*c*. The circumferentially-extending wall 12*g* and the base wall 12*b* define a second region, or second portion, 12*gj*. A plurality of fins 12*h* extends radially outward from the wall 12*c*, the base wall 12*b* and the wall 12*g*. A plurality of fins 12*i* extend axially from the base wall 12*b*, and extend radially inward from the wall 12*g*. A generally cylindrically-shaped region 12*j* is generally defined by the distal ends of the fins in the plurality of fins 12*i* that generally oppose the inside surface of the wall 12*g*. A center through-hole 12*k* extends through the base wall 12*b*.

An insert feature 12*l* extends from the inside surface of the wall 12*c* and along the axial length of the first region, or first portion. 12*a*, defining a generally flat surface 12*la* that is about parallel to the horizontal, as viewed in FIG. 4B. A generally square-shaped relief portion 12*m* extends from the base wall 12*b* and into the first region, or first portion, 12*a*, defining a generally flat surface 12*ma*. Pairs of aligned bosses 12*na* and 12*nb*, and 12*oa* and 12*ob*, having respective openings formed therein, extend upwardly from the base wall 12*b*, and are symmetrically spaced from the relief portion 12*m*, as viewed in FIG. 4A. Bosses 12*pa*, 12*pb*, 12*pc* and 12*pd* extend downwardly from the base wall 12*b*, and have respective openings formed therein. In an exemplary embodiment, the housing 12 is composed of a copper-free, die-cast aluminum alloy. The housing 12 defines an overall height 12*q* and an outer diameter 12*r*. In an exemplary embodiment, the overall height 12*q* is about six (6) inches, and the outer diameter 12*r* is about eleven (11) inches. The housing 12 further includes through-holes 12*s* and 12*t*.

Figure 5:
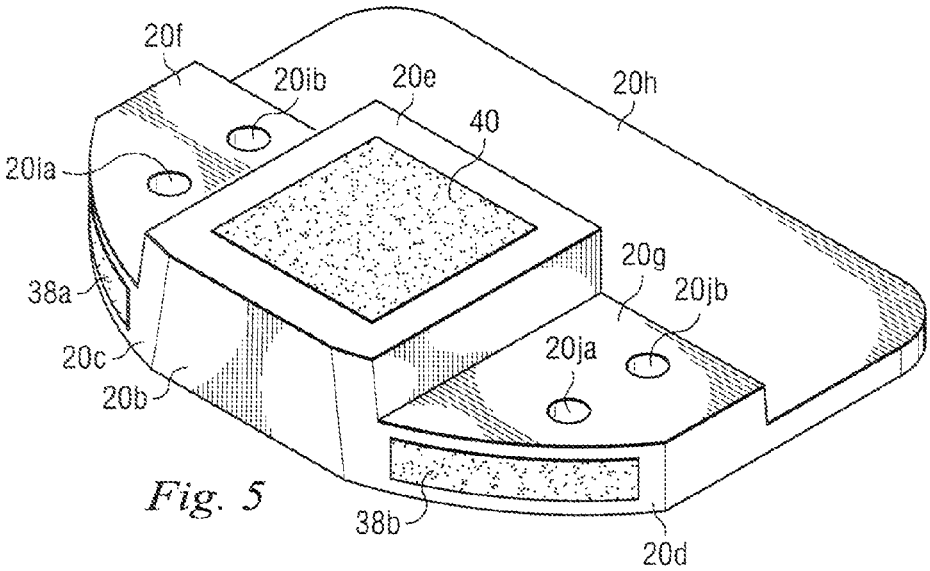
FIG. 5 is a perspective view of a mounting block according to an embodiment, which is depicted in FIG. 2.

In an exemplary embodiment, as illustrated in FIG. 5, the mounting block 20 further defines a generally vertically-extending surface 20*b*, a pair of curved surfaces 20*c* and 20*d*, which are arranged symmetrically on either side of the surface 20*b*, a generally horizontally-extending surface 20*e*, generally horizontally-extending surfaces 20*f* and 20*g*, which are offset from the surface 20*e*, and a generally horizontally-extending surface 20*h*, which is offset from the surfaces 20*f* and 20*g*. Counterbores 20*ia* and 20*ib* extend through the mounting block 20, with the respective increased-diameter portions of the counterbores 20*ia* and 20*ib* being formed in the surface 20*a* and the respective reduced-diameter portions of the counterbores 20*ia* and 20*ib* being formed in the surface 20*f*. Similarly, counterbores 20*ja* and 20*jb* extend through the mounting block 20, with the respective increased-diameter portions of the counterbores 20*ja* and 20*jb* being formed in the surface 20*a* and the respective reduced-diameter portions being formed in the surface 20*g*.

Generally rectangular-shaped thermal pads 38*a* and 38*b* are adapted to engage the surfaces 20*c* and 20*d*, respectively, of the mounting block 20, and are adapted to provide thermally-conductive interfaces between the inside surface of the wall 12*c* of the housing 12 and the surfaces 20*c* and 20*d*, respectively, of the mounting block 20, under conditions to be described. In an exemplary embodiment, the thermal pads 38*a* and 38*b* are adapted to fill one or more air gaps between the inside surface of the wall 12*c* of the housing 12 and the surfaces 20*c* and 20*d*, respectively, under conditions to be described. In several exemplary embodiments, the thermal pads 38*a* and 38*b* may each comprise a thickness of about 0.020 inches. In several exemplary embodiments, the thermal pads 38*a* and 38*b* may each comprise a material that is substantially similar to the material of which the thermal pad 24 is comprised, as described above. A generally square-shaped thermal pad 40 is adapted to engage the surface 20*e* of the mounting block 20, and is adapted to provide a thermally-conductive interface between the surface 20*e* and the surface 12*ma* of the housing 12. In an exemplary embodiment, the thermal pad 40 is adapted to fill one or more air gaps between the surface 20*e* and the surface 12*ma* of the housing 12, under conditions to be described. In several exemplary embodiments, the thermal pad 40 comprises a thickness of about 0.020 inches. In several exemplary embodiments, the thermal pad 40 comprises a material that is substantially similar to the material of which the thermal pad 24 is comprised, as described above.

Figure 6:
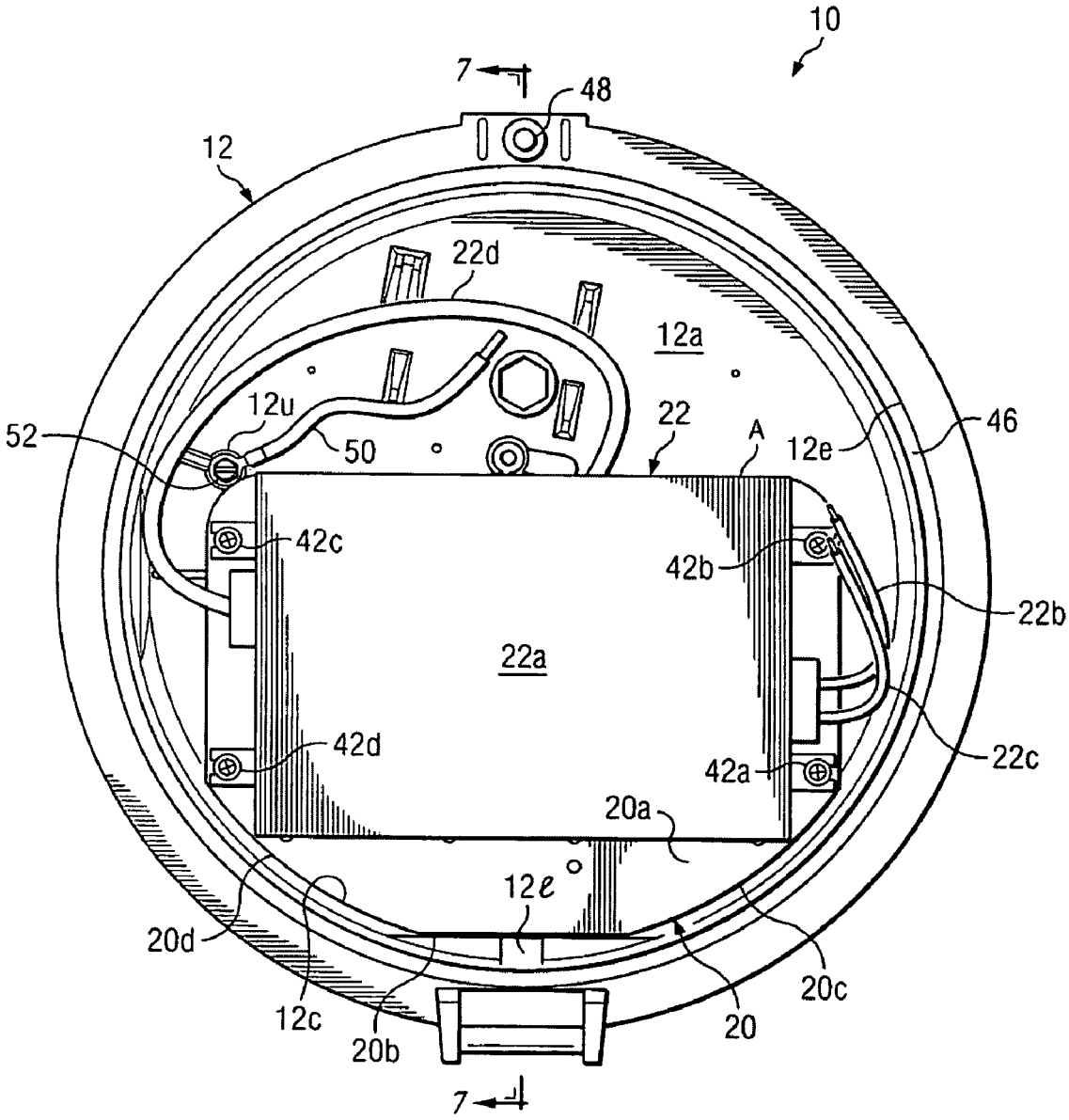
FIG. 6 is a top plan view of the lighting fixture of FIG. 1, with the cover removed from view.
Figure 7:
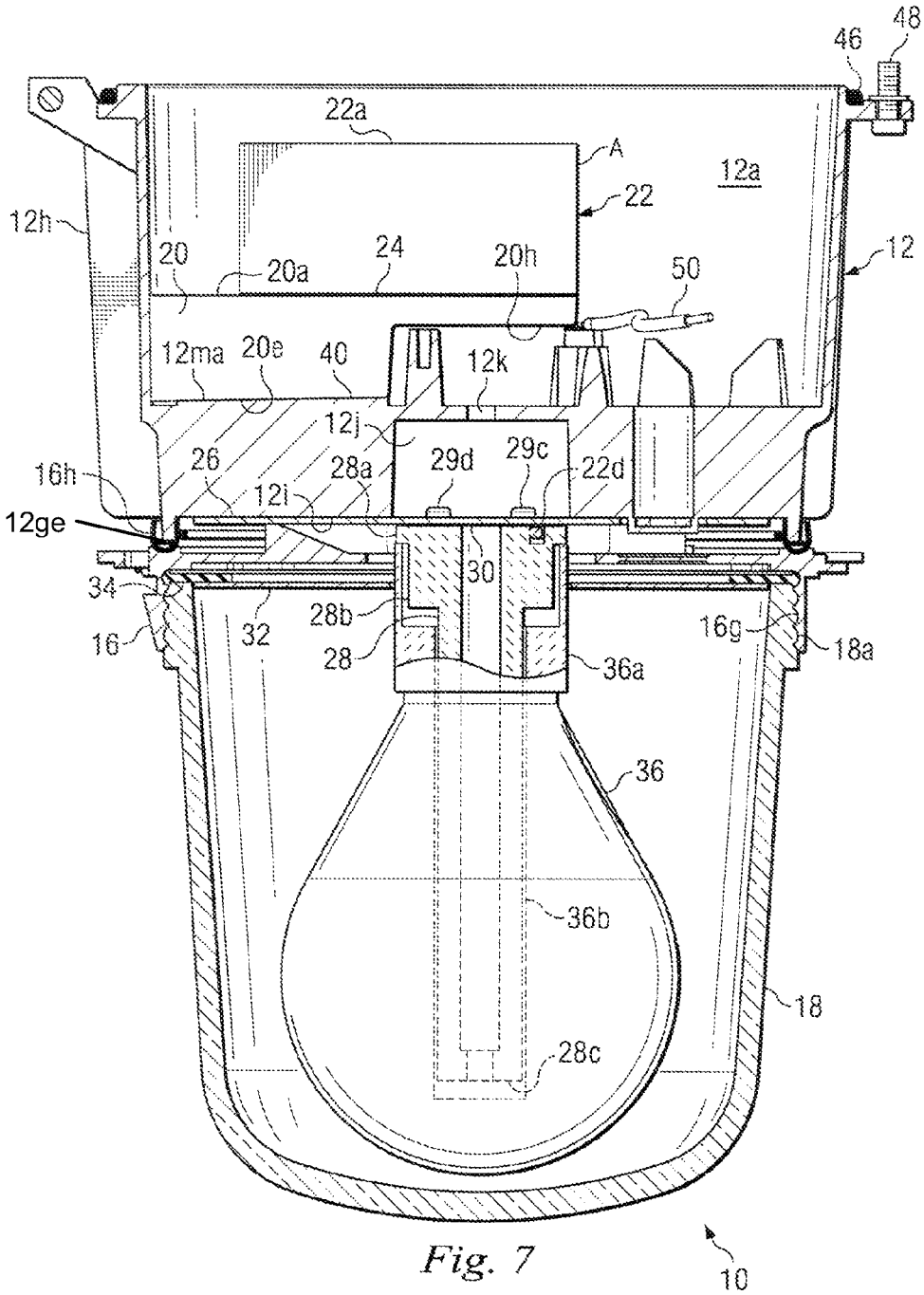
FIG. 7 is a sectional view of the lighting fixture of FIG. 6 taken along line 7-7.

In an exemplary embodiment, as illustrated in FIGS. 2, 6 and 7, the mounting block 20 is coupled to the housing 12 via fasteners that extend through the counterbores 20*ia*, 20*ib*, 20*ja* and 20*jb* and into the openings of the bosses 12*oa*, 12*ob*, 12*na* and 12*nb*, respectively. As a result, the thermal pads 38*a* and 38*b* are disposed between and engage the inside surface of the wall 12*c* of the housing 12 and the surfaces 20*c* and 20*d*, respectively, of the mounting block 20, thereby filling one or more of any air gaps therebetween. In several exemplary embodiments, the thermal pads 38*a* and 38*b* may be engaged with either the inside surface of the wall 12*c* or the surfaces 20*c* and 20*d*, respectively, prior to the assembly of the lighting fixture 10, or may be disposed therebetween during the assembly of the lighting fixture 10.

Moreover, the thermal pad 40 is disposed between and engages the surface 12*ma* of the housing 12 and the surface 20*e* of the mounting block 20, thereby filling one or more of any air gaps therebetween. In several exemplary embodiments, the thermal pad 40 may be engaged with either the surface 12*ma* or the surface 20*e* prior to the assembly of the lighting fixture 10, or may be disposed therebetween during the assembly of the lighting fixture 10. Also, the surface 20*b* of the mounting block 20 engages or is proximate the surface 12*la* of the housing 12.

Fasteners 42*a*, 42*b*, 42*c* and 42*d* extend through respective tabs of the HF generator 22 and into the mounting block 20, thereby coupling the HF generator 22 to the mounting block 20. As a result, the thermal pad 24 is disposed between and engages the housing 22*a* of the HF generator 22, and the surface 20*a* of the mounting block 20, thereby filling one or more of any air gaps therebetween.

Fasteners 44*a*, 44*b*, 44*c* and 44*d* extend through the holes 16*c*, 16*d*, 16*e* and 16*f*, respectively, of the globe adapter 16, the notches 26*e*, 26*f*, 26*g* and 26*h*, respectively, of the mounting plate 26, and into the openings in the bosses 12*pa*, 12*pb*, 12*pc* and 12*pd*, respectively, of the housing 12, thereby coupling the globe adapter 16 to the housing 12, causing the mounting plate 26 to engage the fins 12*i* of the housing 12, causing the globe adapter gasket 16*h* to sealingly engage the globe adapter 16 and the distal end of the wall 12*g* of the housing 12, and causing the globe gasket 34 to sealingly engage the globe adapter 16 and the globe 18, as shown in FIG. 7.

When the lighting fixture 10 is in an installed condition, a gasket 46 is disposed in the channel 12*e* of the housing 12, and the cover 14 is closed and locked to the housing 12 via a fastener 48, thereby causing the gasket 46 to sealingly engage the cover 14. In an exemplary embodiment, the lighting fixture 10 is mounted to a support bracket or structure such as, for example, a pendant, which is coupled to an overhead support structure such as a ceiling; a wall bracket, which is mounted to a vertically-extending support structure such as a wall; a stanchion, which is mounted to a horizontally-extending support structure such as a floor; a ceiling mounting bracket, which is mounted to an overhead support structure such as a ceiling; and/or any combination thereof. To mount this support bracket or structure to the lighting fixture 10, the support bracket or structure may include an external threaded connection that engages the internal threaded connection 14*b* of the cover 14.

Moreover, the wires 22*b* and 22*c* of the HF generator 22 are electrically coupled to a source of electrical power, thereby electrically coupling the HF generator 22 to the source of electrical power. In an exemplary embodiment, the HF generator 22 may be electrically coupled to a source of electrical power that is positioned outside of the housing 12, and the wires 22*b* and 22*c* may extend through the opening 14*a* of the cover 14. A ground wire 50 is coupled to a boss 12*u* of the housing 12 via a fastener 52, and is electrically coupled to ground. In an exemplary embodiment, the ground wire 50 may extend through the opening 14*a* of the cover 14. The coaxial cable 22*d* of the HF generator 22 extends within the first region, or first portion, 12*a* of the housing 12, underneath the surface 20*h* of the mounting block 20, through the through-hole 12*k* and into the region 12*j* of the housing 12, and is electrically coupled to the above-described antenna of the cylindrical portion 28*c* of the power coupler 28.

In several exemplary embodiments, due to the use of the above-described components of the lighting fixture 10, including, for example, the gaskets 16*h*, 34 and 46, the lighting fixture 10 may be installed in locations generally classified as Class I, Division 2, Groups A, B, C and/or D locations; locations generally classified as Class I, Zone 2, Groups IIA, IIB and/or IIC locations; wet locations; and/or marine locations.

In operation, electrical power is supplied to the HF generator 22 via the wires 22*b* and 22*c*. In response, the HF generator 22 outputs power in the form of a low voltage, high-frequency current signal such as, for example, a 2.65 Mhz current signal, which is supplied to the antenna of the cylindrical portion 28*c* of the power coupler 28. As a result, the antenna of the cylindrical portion 28*c* of the power coupler 28 creates an electromagnetic field, thereby activating ions in the mercury metal mixture to create ultraviolet (UV) light. The above-described fluorescent phosphor mixture on the inside surface of the lamp 36 converts the generated UV light into visible light. As a result, the lamp 36 provides light to the environment surrounding the lighting fixture 10. In an exemplary embodiment, the power consumption of the lighting fixture 10 may be, for example, about 165 watts. In an exemplary embodiment, the power consumption of the lighting fixture 10 may be, for example, about 230 VAC at about 700 mA, or about 161.00 watts.

During the operation of the lighting fixture 10, the power coupler 28 dissipates power in the form of heat. The majority of this heat flows from the power coupler 28 to the environment surrounding the lighting fixture 10 via several thermal paths. One such thermal path first includes conductive heat transfer from the mounting flange 28*a* of the power coupler 28 to the power-coupler mounting plate 26. The thermal pad 30 provides a thermally conductive interface between the mounting flange 28*a* and the mounting plate 26, promoting conductive heat transfer therebetween. The heat then conducts and spreads across the mounting plate 26, and further flows into the fins 12*i* and the base wall 12*b* of the housing 12 via conductive heat transfer. The heat then conducts and spreads through the housing 12, and then flows into the environment surrounding the lighting fixture 10 via convective heat transfer from the housing 12, including from the fins 12*h*, the wall 12*c*, the wall 12*g* and/or any combination thereof.

Moreover, during the operation of the lighting fixture 10, the HF generator 22 also dissipates power in the form of heat. The majority of this heat flows from the HF generator 22 to the environment surrounding the lighting fixture 10 via several thermal paths. One such thermal path includes conductive heat transfer from the HF generator 22 to the surface 20*a* of the mounting block 20. The thermal pad 24 provides a thermally-conductive interface between the HF generator 22 and the surface 20*a*, promoting conductive heat transfer therebetween. The heat then conducts and spreads through the mounting block 20. A portion of the heat flows from the surfaces 20*c* and 20*d* of the mounting block 20 to the inside surface of the wall 12*c* of the housing 12 via conductive heat transfer. The thermal pads 38*a* and 38*b* provide thermally-conductive interfaces between the mounting block 20 and the wall 12*c* of the housing 12, promoting conductive heat transfer therebetween. Another portion of the heat within the mounting block 20 flows from the surface 20*e* of the mounting block 20 to the surface 12*ma* of the housing 12 via conductive heat transfer. The thermal pad 40 provides a thermally-conductive interface between the mounting block 20 and the surface 12*ma* of the housing 12, promoting conductive heat transfer therebetween. After flowing into the housing 12, the heat then conducts and spreads through the housing 12, and then flows into the environment surrounding the lighting fixture 10 via convective heat transfer from the housing 12, including from the fins 12*h*, the wall 12*c*, the wall 12*g* and/or any combination thereof.

As a result of the above-described heat-transfer mechanisms, heat flow and thermal paths, any heat flow from the power coupler 28 to the HF generator 22 is appreciably reduced, thereby minimizing any temperature increase in the HF generator 22 due to the power dissipation of the power coupler 28.

In several exemplary embodiments, in addition to, or instead of the thermal paths described above, any heat that is generated by the HF generator 22 and/or the power coupler 28 may flow through one or more of the above-described components of the lighting fixture 10 using a wide variety of thermal paths and/or heat transfer modes, including conductive heat transfer, convective heat transfer, radiative heat transfer and/or any combination thereof. Moreover, in several exemplary embodiments, in addition to, or instead of the thermal paths described above, heat may flow into any support structure to which the lighting fixture 10 is coupled.

Referring to FIGS. 6, 7, 8A, 8B, 9, 10A and 10B, experimental testing of the lighting fixture 10 was conducted, with the lighting fixture 10 operating in the above-described manner during the experimental testing.

During at least a portion of the experimental testing, experimental temperature data was recorded, during which the power consumption of the lighting fixture 10 was at least about 165+/−10% watts, that is, at least about 148.5 watts. The experimental temperature of the HF generator 22 was measured using a thermocouple at a point A on the housing 22*a* of the HF generator 22, as shown in FIGS. 6 and 7. The experimental temperature of the HF generator 22 was recorded at an ambient air temperature of 40 degrees C., with ambient air temperature referring to the temperature of the air in the environment surrounding the lighting fixture 10. During the experimental testing, the experimental temperature of the HF generator 22 was measured and recorded with the lighting fixture 10 mounted to the ceiling, and with the lighting fixture 10 mounted to a stanchion. During the experimental testing, the experimental temperature of the HF generator 22 was measured and recorded using the globe 18, and using a refractor in place of the globe 18.

Under any combination of the above-described experimental conditions, the experimental temperature of the HF generator 22 was less than or equal to about 65+/−10% degrees C., that is, less than or equal to about 71.5 degrees C., at an ambient air temperature of about 40 degrees C. Thus, the experimental temperature rise above ambient of the HF generator 22, that is, the difference in temperature between the experimental temperature of the HF generator 22 and the ambient air temperature, was less than or equal to about 31.5 degrees C. This was an unexpected result.

In view of the above-described experimental temperature results, safe end of life of the HF generator 22 is highly likely because the experimental temperatures of the HF generator 22 was always less than about 82 degrees C., the temperature above which safe end of life of the HF generator 22 cannot be assured.

Using the U.S. method, the above-described experimental temperature results show that the lamp 36 of the lighting fixture 10 has an average lamp life of about 100,000 hours. Under the U.S. method, average life is determined by placing 100 lamps in a room. The time it takes for the first 50 lamps to burn out (50% survival) is the average life. Lamp life is affected by temperature. For the lighting fixture 10, the lamp 36 has an average life of about 100,000 hours with a 50% failure rate if the temperature at the point A on the housing 22*a* of the HF generator 22 is less than or equal to about 65+/−10% degrees C., that is, less than or equal to about 71.5 degrees C., during the operation of the lighting fixture 10.

Determining that the lamp 36 of the lighting fixture 10 has an average lamp life of about 100,000 hours using the U.S. method was an unexpected result.

Using the European method, the above-described experimental temperature results show that the lamp 36 of the lighting fixture 10 has an average life of about 60,000 hours. Under the European method, average life is determined by placing 100 lamps in a room. The time it takes for the first 10 lamps to burn out (10% survival) is the average life. As noted above, lamp life is affected by temperature. For the lighting fixture 10, the lamp 36 has an average life of about 60,000 hours with a 10% failure rate if the temperature at the point A on the housing 22*a* of the HF generator 22 is less than or equal to about 65+/−10% degrees C., that is, less than or equal to about 71.5 degrees C., during the operation of the lighting fixture 10. Determining that the lamp 36 of the lighting fixture 10 has an average, lamp life of about 60,000 hours using the European method was an unexpected result.

Figures 8A, 8B:
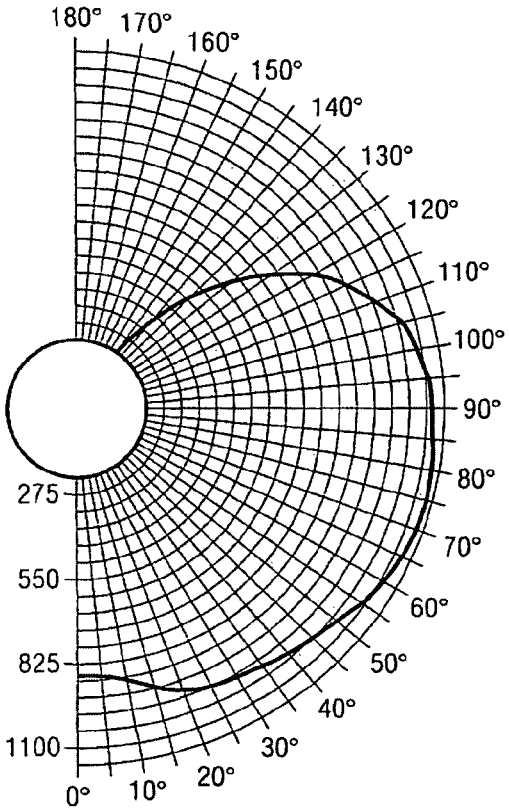
FIG. 8A is a graph showing the experimental candlepower distribution of the lighting fixture of FIG. 1.
FIG. 8B is a table showing the experimental candelas and zonal lumens of the lighting fixture of FIG. 1.
Figures 9, 10A, 10B:
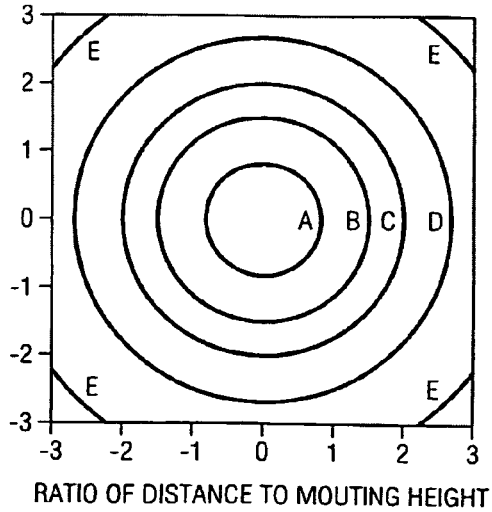
FIG. 9 is a table showing the experimental coefficients of utilization for the lighting fixture of FIG. 1.
FIG. 10A is an experimental isofootcandle chart for the lighting fixture of FIG. 1.
FIG. 10B is a graph showing the isofootcandle lines for the lighting fixture of FIG. 1.

During the experimental testing, experimental photometric data was recorded, during which the power consumption of the lighting fixture 10 was at least about 165+/−10% watts, that is, at least about 148.5 watts. Moreover, the lamp 36 provided 12,000 initial lumens and 9,600 mean lumens, with mean lumens referring to the average quantity of light output over the life of the lamp. The initial efficacy of the lamp 36 was 72 lumens/watt and the mean efficacy was 58 lumens/watt. For the lighting fixture 10, the experimental candlepower distribution in candelas is shown in FIG. 8A, and the experimental candelas and zonal lumens are shown in FIG. 8B. Experimental coefficients of utilization, having an effective floor cavity reflectance of 20%, are shown in FIG. 9. An experimental isofootcandle chart is shown in FIG. 10A, indicating experimental illuminance in footcandles at ground level for the isofootcandle lines plotted in FIG. 10B, which indicates the ratio of distance to mounting height.

In comparison to the lighting fixture 10, which uses a 165-watt induction lighting system, a conventional lighting fixture using a conventional 175-watt metal halide pulse start lamp provides 13,500 initial lumens and 8,775 mean lumens, and has an average life of about 15,000 hours using the U.S. method. As a result, it is clear that the lighting fixture 10 provides about as much light as a conventional lighting fixture using a conventional 175-watt metal halide pulse start lamp but lasts about seven (7) times longer. The relatively high average life of the lamp 36 of the lighting fixture 10 significantly lowers the overall cost of maintaining and/or replacing the lighting fixture 10, in terms of both parts and labor. For example, and on average using the U.S. method, if the lighting fixture 10 provides 100 hours of illumination per week, over nineteen years will pass before the lighting fixture 10 has to be replaced.

In view of the experimental testing results, the capability of the lighting fixture 10 to consume about 165+/−10% watts of power, to provide about 12,000 initial lumens and 9,600 mean lumens, and to have an average life of about 100,000 hours using the U.S. method, while housing the HF generator 22 in a housing as compact and small as the housing 12—the overall height 12*q* of which is about six (6) inches and the outer diameter 12*r* of which is about eleven (11) inches—was an unexpected result.

In an exemplary experimental embodiment, a vapor-tight seal was installed in the opening 14*a* of the cover 14 and the lighting fixture 10 was operated in the above-described manner, consuming about 165+/−10% watts of power. Due to the vapor-tight seal in the opening 14*a*, gases were generally prevented from flowing between the first region, or first portion, 12*a* of the housing 12 and the environment surrounding the lighting fixture 10. Experimental temperature testing was conducted, during which the outside surface temperature of the globe 18 was measured and recorded at an ambient air temperature of about 40 degrees C. At an ambient air temperature of about 40 degrees C., the experimental outside surface temperature of the globe 18 was less than or equal to about 100 degrees C. Thus, the experimental temperature rise above ambient of the outside surface of the globe 18, that is, the difference in temperature between the experimental temperature of the outside surface of the globe 18 and the ambient air temperature, was less than or equal to about 60 degrees C. This was an unexpected result. The above-described experimental temperature test results show that the lighting fixture 10 delivers a T-rating of T5, pursuant to publication 79-0 of the International Electro-Technical Commission (IEC). In view of the experimental test results, the capability of the lighting fixture 10 to provide 12,000 initial lumens and a T-rating of T5 was an unexpected result.

Figure 11A:
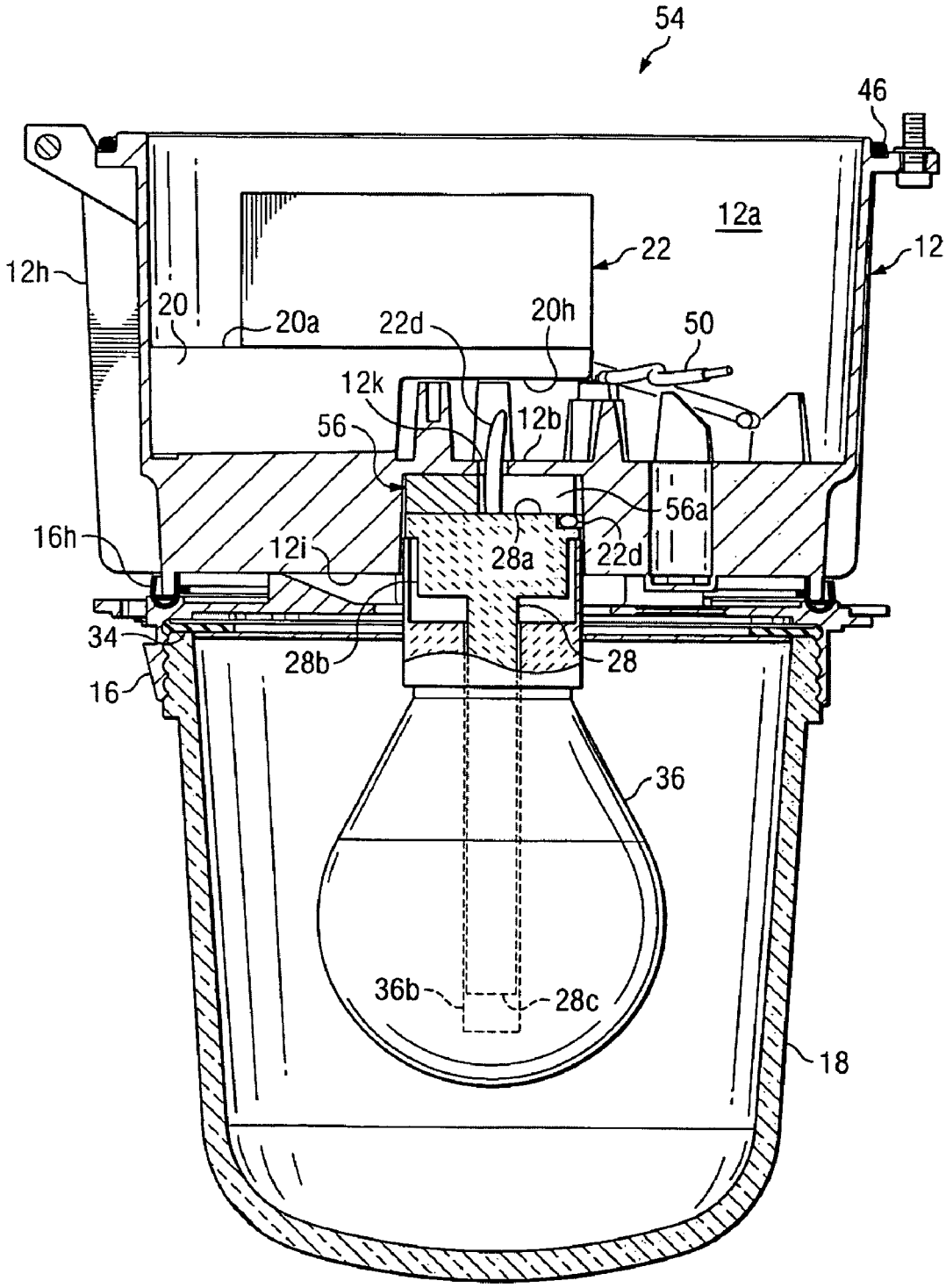
FIG. 11A is a sectional view of a lighting fixture according to another embodiment.
Figure 11B:
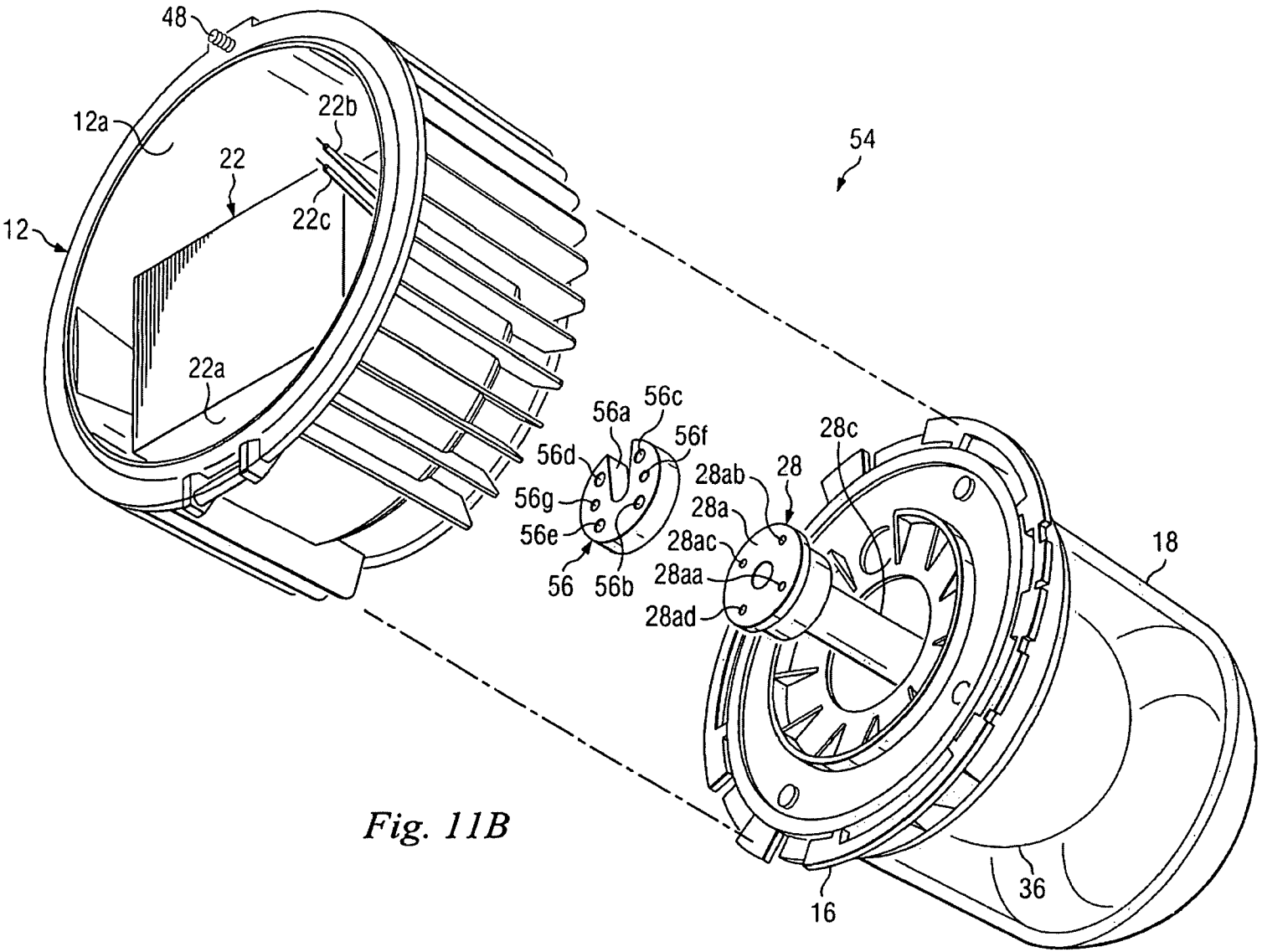
FIG. 11B is a partially exploded/partially unexploded view of the lighting fixture of FIG. 11A.

In an exemplary embodiment, as illustrated in FIGS. 11A and 11B, a lighting fixture is referred to in general by the reference numeral 54, and includes several parts of the lighting fixture 10 of FIGS. 1 through 10B, which are given the same reference numerals.

As shown in FIGS. 11A and 11B, the lighting fixture 54 includes a power-coupler mounting block 56, which includes a notch 56*a* and is coupled to the mounting flange 28*a* of the power coupler 28 via a plurality of fasteners (not shown) that extend through counterbores 56*b*, 56*c*, 56*d* and 56*e* of the power-coupler mounting block 56 and into the holes 28*aa*, 28*ab*, 28*ac* and 28*ad*, respectively, of the power coupler 28. In an exemplary embodiment, the power-coupler mounting block 56 comprises a thermal conductivity of about 167 W/mK. In an exemplary embodiment, the power-coupler mounting block 56 comprises an aluminum alloy. In an exemplary embodiment, the power-coupler mounting block comprises 6061 T6 aluminum alloy. The power-coupler mounting block 56 is coupled to the wall 12*b* of the housing 12 via a pair of fasteners (hot shown) that extend through the holes 12*s* and 12*t* of the housing 12 and into holes 56*f* and 56*g*; respectively, of the power-coupler mounting block 56.

As shown in FIG. 11B, the coaxial cable 22*d* of the HF generator 22 extends within the first region, or first portion, 12*a* of the housing 12, underneath the surface 20*h* of the mounting block 20, through the through-hole 12*k* of the housing 12, and through the notch 56*a* of the power-coupler mounting block 56, and is electrically coupled to the above-described antenna of the cylindrical portion 28*c* of the power coupler 28.

The remaining components of the lighting fixture 54, and the couplings therebetween, are substantially identical to corresponding components of the lighting fixture 10, which are given the same reference numerals as noted above, and the couplings therebetween, and therefore will not be described in detail. As shown in FIGS. 11A and 11B, the lighting fixture 54 does not include components that are substantially similar to the power-coupler mounting plate 26 and the thermal pad 30 of the lighting fixture 10. In several exemplary embodiments, the installed condition of the lighting fixture 54 is substantially similar to the installed condition of the lighting fixture 10, and therefore will not be described in detail.

In operation, the lighting fixture 54 provides light to the environment surrounding the lighting fixture 54 in a manner substantially similar to the above-described manner in which the lighting fixture 10 provides light to the environment surrounding the lighting fixture 10, and therefore the provision of light by the lighting fixture 54 will not be described in detail.

During the operation of the lighting fixture 54, the power coupler 28 dissipates power in the form of heat. The majority of this heat flows from the power coupler 28 to the environment surrounding the lighting fixture 54 via several thermal paths. One such thermal path first includes conductive heat transfer from the mounting flange 28*a* of the power coupler 28 to the power coupler mounting block 56. The heat then conducts and spreads through the power coupler mounting block 56, and further flows into the base wall 12*b* of the housing 12 via conductive heat transfer. The heat then conducts and spreads through the housing 12, and then flows into the environment surrounding the lighting fixture 54 via convective heat transfer from the housing 12, including from the fins 12*h*, the wall 12*c*, the wall 12*g* and/or any combination thereof.

Moreover, during the operation of the lighting fixture 54, the HF generator 22 also dissipates power in the form of heat. The majority of this heat flows from the HF generator 22 to the environment surrounding the lighting fixture 54 in a manner similar to the above-described manner in which heat flows from the HE generator 22 to the environment surrounding the lighting fixture 10. Therefore, the heat flow from the HF generator 22 of the lighting fixture 54, to the environment surrounding the lighting fixture 54, will not be described in detail.

As a result of the above-described heat-transfer mechanisms, heat flow and thermal paths, any heat flow from the power coupler 28 to the HF generator 22 is appreciably reduced, thereby minimizing any temperature increase in the HF generator 22 due to the power dissipation of the power coupler 28.

Experimental testing of the lighting fixture 54 was conducted, with the lighting fixture 54 operating in the above-described manner/during the experimental testing.

During at least a portion of the experimental testing, experimental temperature data was recorded, during which the power consumption of the lighting fixture 54 was at least about 165+/−10% watts, that is, at least about 148.5 watts. The experimental temperature of the HF generator 22 was measured using a thermocouple at the point A on the housing 22*a* of the HF generator 22. The experimental temperature of the HF generator 22 was recorded at an ambient air temperature of 40 degrees C., with the ambient air referring to the temperature of the air in the environment surrounding the lighting fixture 10. During the experimental testing, the experimental temperature of the HF generator 22 was measured and recorded with the lighting fixture 10 mounted to the ceiling. During the experimental testing, the experimental temperature of the HF generator 22 was measured and recorded using the globe 18.

Under the above-described experimental conditions, the experimental temperature of the HF generator 22 was less than or equal to about 65+/−10% degrees C., that is, less than or equal to about 71.5 degrees C., at an ambient air temperature of about 40 degrees C. Thus, the experimental temperature rise above ambient of the HF generator 22, that is, the difference in temperature between the experimental temperature of the HF generator 22 and the ambient air temperature, was less than or equal to about 31.5 degrees C. This was an unexpected result.

In view of the above-described experimental results, safe end life of the HF generator 22 of the lighting fixture 54 is highly likely because the experimental temperature of the HF generator 22 of the lighting fixture 54 was less than 82 degrees C., the temperature above which safe end of life of the HF generator 22 cannot be assured. Using the above-described U.S. method, the above-described experimental results show that the lamp 36 of the lighting fixture 54 has an average life of about 100,000 hours. This was an unexpected result. Using the above-described European method, the above-described experimental results show that the lamp 36 of the lighting fixture 54 has an average life of about 60,000 hours. This was an unexpected result.

A lighting fixture has been described that includes a lamp; a power coupler coupled to the lamp; a high-frequency generator electrically coupled to the power coupler; a housing defining a region in which the high-frequency generator is disposed; a mounting block coupled to the housing and the high-frequency generator, the mounting block being adapted to receive heat from the high-frequency generator; and a device coupled to the power coupler and the housing, the device being adapted to receive heat from the power coupler. In an exemplary embodiment, the mounting block defines a first surface; and wherein the lighting fixture further comprises a first thermal pad disposed between the high-frequency generator and the first surface of the mounting block for providing a thermally-conductive interface between the high-frequency generator and the first surface of the mounting block. In an exemplary embodiment, the mounting block defines a second surface; and wherein the lighting fixture further comprises a second thermal pad disposed between the second surface of the mounting block and the housing for providing a thermally-conductive interface between the second surface of the mounting block and the housing. In an exemplary embodiment, the mounting block defines a third surface; and wherein the lighting fixture further comprises a third thermal pad disposed between the third surface of the mounting block and the housing for providing a thermally-conductive interface between the third surface of the mounting block and the housing. In an exemplary embodiment, the mounting block defines a fourth surface; and wherein the lighting fixture further comprises a fourth thermal pad disposed between the fourth surface of the mounting block and the housing for providing a thermally-conductive interface between the fourth surface of the mounting block and the housing. In an exemplary embodiment, the device comprises a mounting plate; wherein the power coupler comprises a flange to which the mounting plate is coupled; and wherein the lighting fixture further comprises a thermal pad disposed between the flange and the mounting plate for providing a thermally-conductive interface between the flange and the mounting plate. In an exemplary embodiment, the device comprises another mounting block; and wherein the power coupler comprises a flange to which the another mounting block is coupled. In an exemplary embodiment, the lighting fixture is adapted to consume at least about 165+/−10% watts of power during operation; wherein the lamp is adapted to provide at least about 12,000 initial lumens; and wherein the temperature rise above ambient of at least a portion of the high-frequency generator is less than about 32 degrees C. during the operation of the lighting fixture. In an exemplary embodiment, the lighting fixture is adapted to consume at least about 165+/−10% watts of power during operation; wherein the lamp is adapted to provide at least about 12,000 initial lumens; and wherein the lamp comprises an average life of at least about 100,000 hours with a 50% failure rate. In an exemplary embodiment, the housing comprises an overall height of less than or equal to about 6.5 inches; and an outer diameter of less than or equal to about 11.5 inches. In an exemplary embodiment, the lighting fixture comprises a globe coupled to the housing, the globe defining an outside surface; a cover coupled to the housing, the cover comprising an opening; and a vapor-tight seal disposed in the opening; wherein the lighting fixture is adapted to consume at least about 165+/−10% watts of power during operation; wherein the lamp is adapted to provide at least about 12,000 initial lumens; and wherein the temperature rise above ambient of the outside surface of the globe is less than or equal to about 60 degrees C. during the operation of the lighting fixture.

A lighting fixture has been described that includes a lamp; a power coupler coupled to the lamp, the power coupler comprising a flange; a high-frequency generator electrically coupled to the power coupler; a housing defining a region in which the high-frequency generator is disposed, a mounting block coupled to the housing and the high-frequency generator, the mounting block being adapted to receive heat from the high-frequency generator; and a mounting plate coupled to the flange; and the housing, the mounting plate being adapted to receive heat from the power coupler; wherein the mounting block defines first, second, third and fourth surfaces; wherein the lighting fixture further comprises a first thermal pad disposed between the high-frequency generator and the first surface of the mounting block for providing a thermally-conductive interface between the high-frequency generator and the first surface of the mounting block; a second thermal pad disposed between the second surface of the mounting block and the housing for providing a thermally-conductive interface between the second surface of the mounting block and the housing; a third thermal pad disposed between me third surface of the mounting block and the housing for providing a thermally-conductive interface between the third surface of the mounting block and the housing; a fourth thermal pad disposed between the fourth surface of the mounting block and the housing for providing a thermally-conductive interface between the third surface of the mounting block and the housing; and a fifth thermal pad disposed between the flange and the mounting plate for providing a thermally-conductive interface between the flange and the mounting plate; wherein the lighting fixture is adapted to consume at least about 165+/−10% watts of power during operation; wherein the lamp is adapted to provide at least about 12,000 initial lumens; wherein the lamp comprises an average life of at least about 100,000 hours with a 50% failure rate; and wherein the temperature rise above ambient of at least a portion of the high-frequency generator is less than about 32 degrees C. during the operation of the lighting fixture.

A method has been described that includes consuming at least about 165+/−10% watts of power using a lighting fixture, the lighting fixture comprising a lamp; providing at least about 12,000 initial lumens using the lighting fixture; and providing the lamp with an average life of at least about 100,000 hours with a 50% failure rate. In an exemplary embodiment, the lighting fixture further comprises a power coupler coupled to the lamp, and a high-frequency generator electrically coupled to the power coupler, and wherein providing the lamp with an average life of at least about 100,000 hours with a 50% failure rate comprises maintaining the temperature rise above ambient of at least a portion of the high-frequency generator at less than about 32 degrees C. during consuming at least about 165+/−10% watts of power using the lighting fixture. In an exemplary embodiment, the lighting fixture further comprises a housing defining a region, in which the high-frequency generator is disposed. In an exemplary embodiment, the housing comprises an overall height of less than or equal to about 6.5 inches; and an outer diameter of less than or equal to about 11.5 inches. In an exemplary embodiment, the lighting fixture further comprises a globe coupled to the housing, the globe defining an outside surface; and wherein the method further comprises generally preventing one or more gases from flowing between the region defined by the housing and the environment surrounding the housing; and maintaining the temperature rise above ambient of the outside surface of the globe at less than or equal to about 60 degrees C. during consuming at least about 165+/−10% watts of power using the lighting fixture.

A method has been described that includes consuming at least about 165+/−10% watts of power using a lighting fixture, the lighting fixture comprising a lamp; a power coupler coupled to the lamp; a high-frequency generator electrically coupled to the power coupler; a housing defining a region in which the high-frequency generator is disposed; and a globe coupled to the housing, the globe defining an outside surface; providing at least about 12,000 initial lumens using the lighting fixture; providing the lamp with an average life of at least about 100,000 hours with a 50% failure rate, comprising maintaining the temperature rise above ambient of at least a portion of the high-frequency generator at less than about 32 degrees C. during consuming at least about 165+/−10% watts of power using the lighting fixture; optionally generally preventing one or more gases from flowing between the region and the environment surrounding the housing; and when generally preventing the one or more gases from flowing between the region and the environment surrounding the housing, maintaining the temperature rise above ambient of the outside surface of the globe at less than or equal to about 60 degrees C. during consuming at least about 165+/−10% watts of power using the lighting fixture.

A system has been described that includes means for consuming at least about 165+/−10% watts of power using a lighting fixture, the lighting fixture comprising a lamp; means for providing at least about 12,000 initial lumens using the lighting fixture; and means for providing the lamp with an average life of at least about 100,000 hours with a 50% failure rate. In an exemplary embodiment, the lighting fixture further comprises a power coupler coupled to the lamp, and a high-frequency generator electrically coupled to the power coupler, and wherein means for providing the lamp with an average life of at least about 100,000 hours with a 50% failure rate comprises means for maintaining the temperature rise above ambient of at least a portion of the high-frequency generator at less than about 32 degrees C. during consuming at least about 165+/−10% watts of power using the lighting fixture. In an exemplary embodiment, the lighting fixture further comprises a housing defining a region in which the high-frequency generator is disposed. In an exemplary embodiment, the housing comprises an overall height of less than or equal to about 6.5 inches; and an outer diameter of less than or equal to about 11.5 inches. In an exemplary embodiment, the lighting fixture further comprises a globe coupled to the housing, the globe defining an outside surface; and wherein the system further comprises means for generally preventing one or more gases from flowing between the region defined by the housing and the environment surrounding the housing; and means for maintaining the temperature rise above ambient of the outside surface of the globe at less than or equal to about 60 degrees C. during consuming at least about 165+/−10% watts of power using the lighting fixture.

A system has been described that includes means for consuming at least about 165+/−10% watts of power using a lighting fixture, the lighting fixture comprising a lamp; a power coupler coupled to the lamp; a high-frequency generator electrically coupled to the power coupler; a housing defining a region in which the high-frequency generator is disposed; and a globe coupled to the housing, the globe defining an outside surface; means for providing at least about 12,000 initial lumens using the lighting fixture; means for providing the lamp with an average life of at least about 100,000 hours with a 50% failure rate, comprising means for maintaining the temperature rise above ambient of at least a portion of the high-frequency generator at less than about 32 degrees C.; optionally means for generally preventing one or more gases from flowing between the region and the environment surrounding the housing; and when generally preventing the one or more gases from flowing between the region and the environment surrounding the housing, means for maintaining the temperature rise above ambient of the outside surface of the globe at less than or equal to about 60 degrees C. during consuming at least about 165+/−10% watts of power using the lighting fixture.

A method has been described that includes consuming at least about 165+/−10% watts of power using a lighting fixture, the lighting fixture comprising a housing defining a region; and a high-frequency generator disposed in the region; and maintaining the temperature rise above ambient of at least a portion of the high-frequency generator at less than about 32 degrees C. during consuming at least about 165+/−10% watts of power using the lighting fixture. In an exemplary embodiment, the lighting fixture further comprises a power coupler electrically coupled to the high-frequency generator; and a lamp coupled to the power coupler. In an exemplary embodiment, the lighting fixture further comprises a globe; coupled to the housing, the globe defining an outside surface; and wherein the method further comprises generally preventing one or more gases from flowing between the region defined by the housing and the environment surrounding the housing; and maintaining the temperature rise above ambient of the outside surface of the globe at less than or equal to about 60 degrees C. during consuming at least about 165+/−10% watts of power using the lighting fixture. In an exemplary embodiment, the housing comprises an overall height of less than or equal to about 6.5 inches; and an outer diameter of less than or equal to about 11.5 inches.

A system has been described that includes means for consuming at least about 165+/−10% watts of power using a lighting fixture, the lighting fixture comprising a housing defining a region; and a high-frequency generator disposed in the region; and means for maintaining the temperature rise above ambient of at least a portion of the high-frequency generator at less than about 32 degrees C. during consuming at least about 165+/−10% watts of power using the lighting fixture. In an exemplary embodiment, the lighting fixture further comprises a power coupler electrically coupled to the high-frequency generator; and a lamp coupled to the power coupler. In an exemplary embodiment, the lighting fixture further comprises a globe coupled to the housing, the globe defining an outside surface, and wherein the system further comprises means for generally preventing one or more gases from flowing between the region defined by the housing and the environment surrounding the housing; and means for maintaining the temperature rise above ambient of the outside surface of the globe at less than or equal to about 60 degrees C. during consuming at least about 165+/−10% watts of power using the lighting fixture. In an exemplary embodiment, the housing comprises an overall height of less than or equal to about 6.5 inches; and an outer diameter of less than or equal to about 11.5 inches.

It is understood that variations may be made in the foregoing without departing from the scope of the disclosure. For example, instead of, or in addition to the above-described induction lighting system, the lamp 36 may provide light to the environment surrounding the lighting fixture 10 and/or 54 using one of more high-intensity-discharge (HID) lamps, one or more incandescent lamps, one or more fluorescent lamps, and/or any combination thereof. Also, other components may be added to the lighting fixture 10 and/or 54 such as, for example, one or more dome reflectors, one or more angle reflectors, one or more guards and/or one or more refractors. Further, the lighting fixture 10 and/or 54 may be installed in a wide variety of other settings, and in a wide variety of other manners such as, for example, being coupled to a support structure without mounting the lighting fixture 10 and/or 54 to an intermediate support bracket or structure. Still further, one or more additional lamps may be included in the lighting fixture 10 and/or 54.

Any spatial references such as, for example, "upper," "lower," "above," "below," "between," "vertical," "angular," "upward," "downward," "side-to-side," "left-to-right," "right-to-left," "top-to-bottom," "bottom-to-top," etc., are for the purpose of illustration only and do not limit the specific orientation or location of the structure described above.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

What is claimed is:

1. A lighting fixture, comprising:

a housing having a central axis, the housing comprising a base wall, at least one first side wall extending from the base wall, the base wall and the at least one first side wall defining a first region, and at least one second side wall extending from the base wall in a direction generally opposite the at least one first side wall, the base wall and the at least one second side wall defining a second region, the second region having a terminus disposed at a position opposite from the base wall;

a plurality of fins positioned within the second region, the plurality of fins extending radially with respect to the central axis;

a plate positioned at the terminus of the second region; and a lamp having a lamp base, wherein the lamp base is coupled to the plate on a side of the plate that is opposite from the base wall.

2. The lighting fixture of claim 1, wherein each of the plurality of fins extends radially outward in a direction from a center of the second region toward the at least one second side wall.

3. The lighting fixture of claim 2, wherein the plurality of fins define a cylindrical cavity in the second region.

4. The lighting fixture of claim 2, wherein the plurality of fins define a cavity substantially within the center of the second region.

5. The lighting fixture of claim 2, wherein the plate is coupled to at least one of the fins.

6. The lighting fixture of claim 1, wherein the second side wall is a circumferentially-extending wall and wherein the plate is coupled to the second side wall.

7. The lighting fixture of claim 1, wherein the plate comprises a mounting plate, and wherein the lamp base comprises a flange to which the mounting plate is coupled.

8. The lighting fixture of claim 7, further comprising a thermal pad disposed between the flange and the mounting plate.

9. The lighting fixture of claim 1, further comprising:

a high-frequency generator disposed in the first region and electrically coupled to the lamp; and a mounting block contacting the high-frequency generator, the base wall, and the first side wall.

10. A lighting fixture, comprising:

a housing having a central axis, a first portion and a second portion, the first and second portions separated by a base wall, the second portion providing an open region on a side of the base wall, wherein the open region is disposed between the base wall and a terminus of the second portion;

a mounting plate coupled to the housing at the terminus of the open region opposing the base wall;

a lamp coupled to the mounting plate and extending in a direction generally opposing the base wall; and a plurality of fins extending radially from the central axis in the second portion.

11. The lighting fixture of claim 10, wherein the plurality of fins define a cylindrical cavity in the second portion.

12. The lighting fixture of claim 10, the plurality of fins defining a cavity within a center of the open region of the second portion.

13. The lighting fixture of claim 10, wherein the mounting plate is coupled to the housing by being couple to at least one of the fins.

14. The lighting fixture of claim 10, wherein the lamp comprises a flange to which the mounting plate is coupled.

15. The lighting fixture of claim 14, further comprising a thermal pad disposed between the flange and the mounting plate.

16. The lighting fixture of claim 10, further comprising:

a high-frequency generator disposed in the first portion and electrically coupled to the lamp; and a mounting block contacting the high-frequency generator, a side wall, and a base wall that define the first portion.

17. A lighting fixture, comprising:

a housing having a central axis, the housing comprising a base wall, a circumferentially-extending first wall extending in a first direction from the base wall, the base wall and the first wall defining a first region, a circumferentially-extending second wall extending from the base wall in a second direction generally opposite to the first direction, the base wall and the second wall defining a second region, the second region having a terminus opposing the base wall, and a plurality of fins disposed inside the second region, the fins being spaced apart and each extending radially from the central axis;

a mounting plate positioned at the terminus of the second region opposing the base wall and defining a terminus of a cavity of the second region;

a lamp having a lamp base, the lamp base being coupled to the mounting plate;

a high-frequency generator electrically coupled to the lamp and disposed in the first region; and a mounting block thermally coupled to the high-frequency generator, the first wall, and the base wall.

18. The lighting fixture of claim 17, wherein fins extend radially outward in a direction from a center of the base wall toward the second wall, the fins defining a substantially cylindrical space in a center of the second region.

* * * * *